United States Patent [19]

Cranston

[11] 4,367,964

[45] Jan. 11, 1983

[54] SERIAL IMPACT CALCULATOR PRINTER WITH DUAL FEED AND VALIDATION MECHANISM

[75] Inventor: Dean H. Cranston, Riverton, Wyo.

[73] Assignee: Eaton Corporation, Cleveland, Ohio

[21] Appl. No.: 179,491

[22] Filed: Aug. 19, 1980

[51] Int. Cl.[3] ..... B41J 11/50

[52] U.S. Cl. ..... 400/605; 400/611; 400/597; 400/574

[58] Field of Search ..... 400/611, 613, 614, 629, 400/636, 605, 608.1, 600.2, 600.3, 608.2, 596, 597, 578, 582, 583, 603, 572, 574, 574.1–574.2, 575, 575.1

[56] References Cited

U.S. PATENT DOCUMENTS

| | | | |
|---|---|---|---|
| 3,048,253 | 8/1962 | Oldenburg et al. | 400/611 X |
| 3,139,818 | 7/1964 | Koehn | 400/611 X |
| 3,212,617 | 10/1965 | Sugizama | 400/621 |
| 3,266,612 | 8/1966 | Kittel et al. | 400/596 |
| 3,429,414 | 2/1969 | Bradbury | 400/611 X |
| 3,653,482 | 4/1972 | Cortona et al. | 400/603 |
| 3,935,938 | 2/1976 | Hodne | 400/611 X |
| 3,986,594 | 10/1976 | Kondur, Jr. | 400/611 X |
| 4,011,811 | 3/1977 | Kodis | 400/621 X |
| 4,229,113 | 10/1980 | Anderson | 400/605 X |
| 4,259,026 | 3/1981 | Hanaoka et al. | 400/572 |

FOREIGN PATENT DOCUMENTS

| | | | |
|---|---|---|---|
| 2716396 | 10/1978 | Fed. Rep. of Germany | 400/605 |
| 2717758 | 10/1978 | Fed. Rep. of Germany | 400/605 |
| 2717126 | 11/1978 | Fed. Rep. of Germany | 400/605 |
| 428588 | 5/1935 | United Kingdom | 400/572 |
| 1212011 | 11/1970 | United Kingdom | 400/611 |

*Primary Examiner*—E. H. Eickholt

*Attorney, Agent, or Firm*—John E. Reilly

[57] ABSTRACT

A printer having a movable print head for printing on a first record medium fed by one feed mechanism also contains a second feed mechanism capable of performing line-by-line feeding of a separate record medium across the print head independently of the main drive and is capable of performing single line or multi-line printing on the separate record medium.

20 Claims, 6 Drawing Figures

SERIAL IMPACT CALCULATOR PRINTER WITH DUAL FEED AND VALIDATION MECHANISM

This invention relates to printer apparatus and more particularly relates to a novel and improved calculator printer of the dot matrix type which is capable of advancing separate record media across the path of the print head for printing.

BACKGROUND AND FIELD OF THE INVENTION

Customarily, desk top calculator printers are comprised of a movable carriage for advancing a print head across the width of a record medium which is fed line-by-line past the print head by a main drive mechanism operated off of the print head drive. As the print head is caused to traverse the record medium, a ribbon cartridge will feed a print ribbon intermediately between the print elements on the print head and the record medium in forming selected characters on the record medium. In many applications, such as, point of sale terminals, it is desirable to record calculations performed by the printer on separate record media, for example, in order to provide the customer with a printed copy of the information recorded on the master record. In such cases, it is often necessary only to provide the customer with totalized information and not the preliminary calculations. However, very often the totalized information may require multi-line recording on the validation or customer copy. Moreover, it is desirable that the customer copy be of limited size such as in ticket form which can be readily inserted and removed from the printer without disturbing the master record. In still other cases, it is advantageous to permit printing on separate rolls comprising the master record which are advanced side-by-side through the printer in addition to the validation or customer copy.

In controlling the advancement of the drive mechanisms, various escapement devices have been employed to incrementally feed or index the record medium past the print head. Representative of such devices is disclosed in U.S. Pat. No. 3,986,594, owned by the assignee of this invention, in which a cam-driven pawl engages a ratchet on the platen to rotate the platen and index the record medium each line or space. A separate detent is utilized to normally lock the platen against movement when not being advanced by the pawl. Other patents of interest which disclose paper drive or line feed mechanisms are U.S. Pat. No. 3,429,414 to Bradbury; Hodne U.S. Pat. No. 3,935,938; and Japanese Utility Model Publication No. 44021/1975. In the smaller printers, however, it is important to be able to minimize the power requirements for indexing the record medium as well as to make the indexing mechanism more compact. These requirements are particularly important where separate index or feed mechanisms are required to perform independent line feed operations. Other considerations in multi-function printers of the type described are establishing guide paths for the record media which will not interfere with one another and avoid time-consuming adjustments or special settings.

SUMMARY OF THE INVENTION

It is therefore an object of the present invention to provide for a novel and improved line feed mechanism for printer apparatus and in particular dot matrix impact printers.

Another object of the present invention is to provide a dual feed mechanism for indexing of separate record media independently of one another into position for printing and to correlate the line feeding of each record medium with the printing of each line.

A further object of the present invention is to provide for an improved pawl and ratchet mechanism which is capable of detenting and advancing a pressure feed roller for a record medium in an efficient and highly reliable manner and specifically in such a way as to minimize the power requirements of the electromagnetic control for each line feed mechanism.

In accordance with the present invention, a dual feed mechanism has been devised for use either with low or high speed printers to permit multi-line advancement of separate record media independently of one another across a common print head. In the preferred form, a printer of the type having a frame upon which is mounted a pair of advancing rollers with external surfaces engageable with one another to form a guide path for advancement of a record medium therebetween and into position for impression of characters thereon by a print head is employed in combination with incremental drive means associated with one of the advancing rollers, the drive means including a ratchet member and indexing means having a pivotal feed pawl of generally U-shaped configuration, the feed pawl defining a drive arm and limit arm movable into engagement with circumferentially spaced teeth on the ratchet member. Means in the form of a return spring are provided to normally urge the drive arm and limit arm of the pawl into engagement with the teeth while releasing means in the form of an electromagnetic actuating member is selectively energizable to retract the drive arm and limit arm away from engagement with the ratchet member. The drive means is operative to advance the feed pawl into engagement with the ratchet member when the releasing means is de-energized so that the drive arm is caused to move into engagement with one of the ratchet teeth so as to advance the record advancing roller a limited distance prior to engagement of a limit arm with a circumferentially spaced tooth on the ratchet member. Preferably, the pawl is constructed with a drive arm provided with a free end shaped to conform to the configuration of the groove between each pair of adjacent teeth on the ratchet member and a limit arm provided with a free end of generally rounded configuration and spaced from the drive arm so as to be movable into sliding engagement with the back surface of a circumferentially spaced tooth of the ratchet member. A first line feed mechanism of the type described controls the advancement of a record medium, such as, paper fed from a supply roll past a stationary print bar rearwardly of a print head. A separate document feed mechanism of the type described is capable of controlling single or multiple line feeding of a document independently of the first feed mechanism past the print head, the document feed mechanism including a vertical guide path to permit insertion of a document between the print bar and print head, and advancing rollers about the guide path are provided with external surfaces engageable with one another to work in cooperation with the incremental drive means to advance the document line-by-line past the print head.

The above and other objects, advantages and features of the present invention will become more readily appreciated and understood from a consideration of a description of a preferred form of invention when taken together with the accompanying drawings, in which:

DETAILED DESCRIPTION OF THE PREFERRED EMBODIMENT

Figure 1:
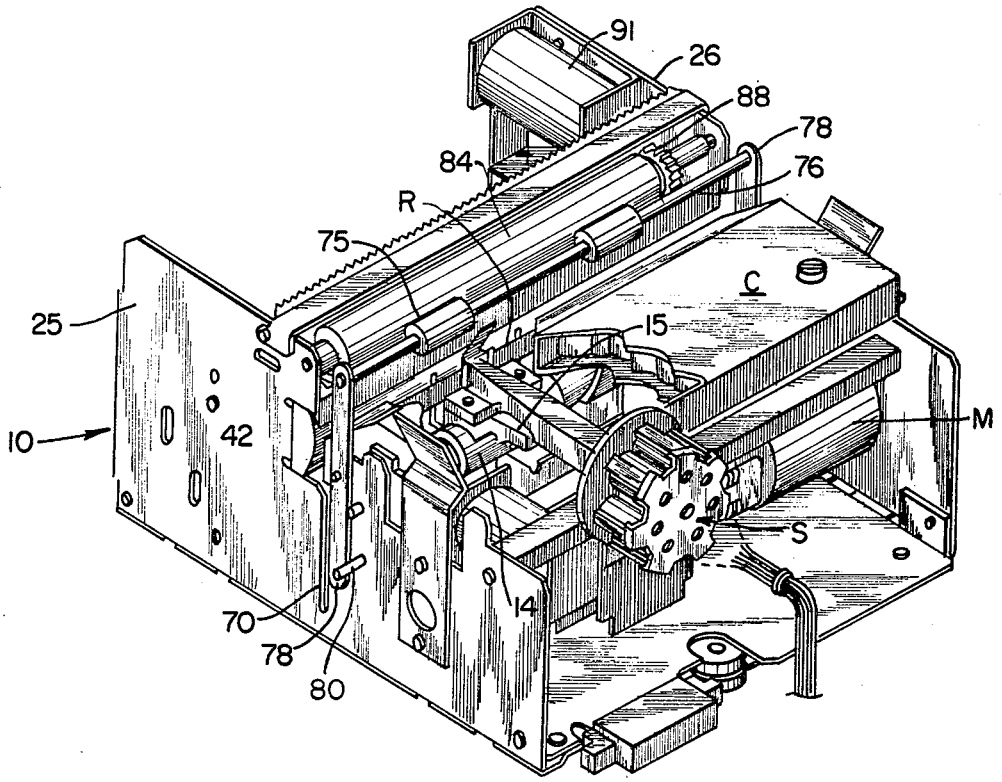
FIG. 1 is a somewhat perspective view of the preferred form of printer in accordance with the present invention illustrating the top level assembly of the printer.
Figure 5:
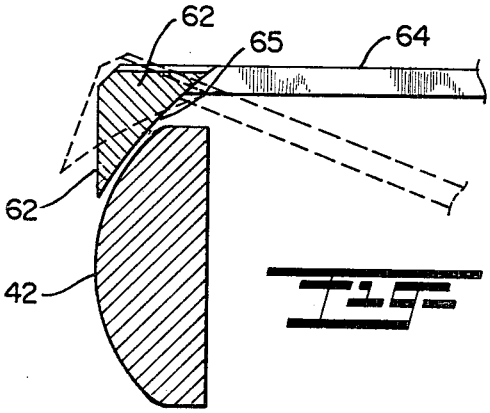
FIG. 5 is an enlarged cross-sectional view of the print bar and tear-off blade of the preferred form of invention.

Referring in detail to the drawings, there is illustrated a preferred form of invention in which a calculator printer 10 is broadly comprised of a print head 12, print head drive mechanism 14, ribbon drive 18 for a ribbon cartridge C and a record medium supply in the form of a roll of paper P which is fed off of a paper feed roll 20 and guided along a predetermined path by paper feed mechanism 22. The basic components as described are mounted on a base frame 24 and opposite side frames 25 and 26, the paper feed roll 20 being supported on a shaft 23 supported in slots 19 in the side frames 25 and 26 at the rearward end of the printer.

In the form of invention shown, the print head 12 is illustrated as being of the clapper type in which a series of solenoids S are arranged in a generally circular array at the front of the printer to activate a series of armatures so as to selectively drive rearwardly extending print wires which strike the print ribbon R to form dot matrix characters on the paper or other record medium.

As shown in FIGS. 1 to 4, the print head drive 14 conventionally includes a carrier assembly 15 having a sleeve or bearing 29 disposed on a drive cam 30 provided with helical grooves 32. In a well-known manner, the drive cam is driven by a DC motor represented at M through a pair of gears 36 and 37 which couple the motor to the drive cam 30; a timing disk 38 controls the motor speed so as to drive the print head across the print area at a constant rate of speed. In a well-known manner, a pin, not shown, within the bearing 29 projects into the groove 32 so that the rotational movement of the groove 32 is converted into linear movement of the print head 12 for bidirectional printing and therefore will drive the print head at a constant rate of speed in both directions of travel reversibly across the print area. Simultaneously, a conventional form of ribbon cartridge C is controlled by the ribbon drive 18 to advance the print ribbon R past a ribbon guide element or print bar 42 which is mounted at the rearward end of the print head 12 on the cylindrical bearing 29.

The paper is delivered from the paper supply roll 20 forwardly along a paper feed path which is formed between an inclined roll paper guide pan 44 extending between the side frames 25 and 26 and a feed roller 46 which is incrementally driven by a ratchet 47 at one end of the feed roller under the control of a feed pawl assembly 48. A pressure roll 49 is suspended in slots 50 in opposite side frames 25 and 26 of the printer and is urged by a leaf spring 51 in a rearwardly and upwardly inclined direction against the surface of the feed roller 46 so as to cause the paper to be advanced upwardly in front of print bar 42 each time that the feed roller 46 is incrementally advanced by the feed pawl assembly 48. The feed pawl assembly 48 includes a generally U-shaped arm 52 mounted for vertically directed pivotal movement at leading end 53' of control arm 53 which is pivoted at 54 with the opposite end of the arm 53 inserted into and affixed to a plunger or armature 55 at the upper end of solenoid 56. One free end of the arm 52 defines a drive arm 52' having a tapered end secured by a return spring 57 to enter one of the grooves or notches formed between the ratchet teeth. The other free end of the yoke 52 defines a limit arm 52" which is rounded and spaced from the arm 52' so as to enter another groove or notch between the ratchet teeth circumferentially spaced from that entered by the drive arm 52'. When the solenoid 56 is energized, the plunger 55 is depressed to lift the arm 52 away from the ratchet 47. When the solenoid 56 is deenergized, the return spring 57 will urge the drive arm 52' downwardly into engagement with a tooth on the ratchet 47 to advance the ratchet 47 in a counterclockwise direction until the limit arm 52" engages a spaced tooth so as to index the paper one line in an upward direction through the vertical paper feed guide path across the print head.

The vertical paper feed guide path includes the print bar 42 which is supported at opposite ends in the side frames 25 and 26 so that its front convex surface is disposed for extension along the upper edge of a paper drag plate 60, the latter mounted for upward extension from the base frame 24. The drag plate 60 presses the paper against the front surface of the print bar 42 so that the paper is caused to travel therebetween, then continue in its upward advancement beneath a generally wedge-shaped tear-off blade 62 which is pivotally mounted by side arms 64 on the opposite side frames 25 and 26 so as to normally extend horizontally in closely-spaced relation to the upper surface of the print bar 42. The blade 62 has a concave undersurface 65 complementary to the convex surface of the pivot bar 42 so as to form a rearwardly directed guide path for continued travel of the paper away from the print bar. The paper may be returned onto a suitable take-up mechanism, not shown, located behind the paper supply roll 20.

A separate guide path or slot is provided in front of the paper feed path for insertion and line printing of a separate record medium, such as, a ticket, card or similar document. The guide path is defined essentially by a vertical slot 70 in side frame 25 directly in front of the print bar 42 and drag plate 60. The slot 70 is aligned to permit insertion of a document such as ticket T in front of the print bar 42. Aligned with the forward vertical edge of the slot 70 is a vertical guide plate 72 which is mounted on the base frame and has an upwardly and forwardly inclined edge 73. Vertically aligned in spaced relation above the plate 72 are spaced rolls 75 mounted on a shaft 76 journaled in openings at the upper ends of a pair of vertically extending support arms 78. The arms 78 are pivotally mounted as at 79 and have their lower ends interconnected by a rod 80 which extends through enlarged openings, not shown, in opposite side frames, and an intermediate portion of the rod 80 is clamped in a slot 81 formed in the leading end of plunger or armature 82 which is disposed for movement toward and away from the guide plate 72 by a solenoid 84. The plunger 82 is normally urged in a direction toward the guide plate 72 by coiled spring element 85 so that the upper rolls 75 are normally spaced in front of document feed roller 86. The document feed roller 86 is mounted for extension between the upper ends of the side frame assembly on the rearward side of the slot 70 so as to define the upper, rearward edge of the guide path for the document feed.

Figure 6:
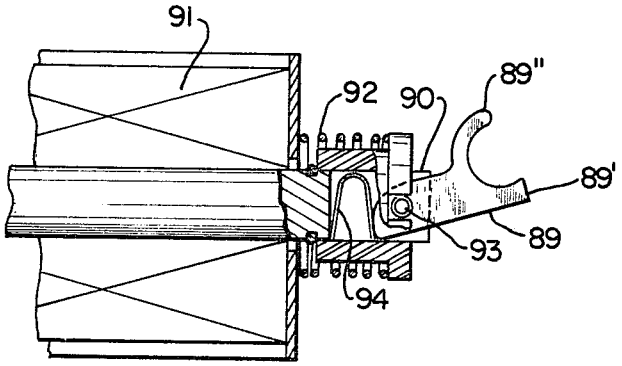
FIG. 6 is a view in detail and partially in section of the preferred form of document feed pawl.

The feed roller 86 is driven in a manner similar to the paper feed roller by a ratchet 88 engageable by a feed pawl 89 at the leading end of a plunger 90 which extends from solenoid 91, the feed pawl having a lower drive arm 89' and upper detent or limit arm 89'', as shown in FIG. 6. It will be noted that the mounting of the feed pawl 89 differs somewhat from that of the paper feed pawl in that the solenoid 91 is mounted for horizontal extension along the inner surface of the upper end of the side frame 26 so that the plunger 90 extends in a horizontal direction toward the ratchet 88 and is normally spring-loaded into an extended position toward the ratchet by means of compression spring 92. In turn, the feed pawl 89 is pivotally mounted by pivot pin 93 at the leading end of the plunger, and a U-shaped spring 94 within the plunger 90 is biased to urge the feed pawl in an upwardly inclining direction with the upper detent or limit arm of the pawl as designated at 89'' engageable with the back surface of a tooth, and the lower, tapered drive arm 89' of the pawl engageable with the front surface of a tooth which is aligned in vertically spaced relation beneath the longitudinal axis of the roller 86.

Figure 2:
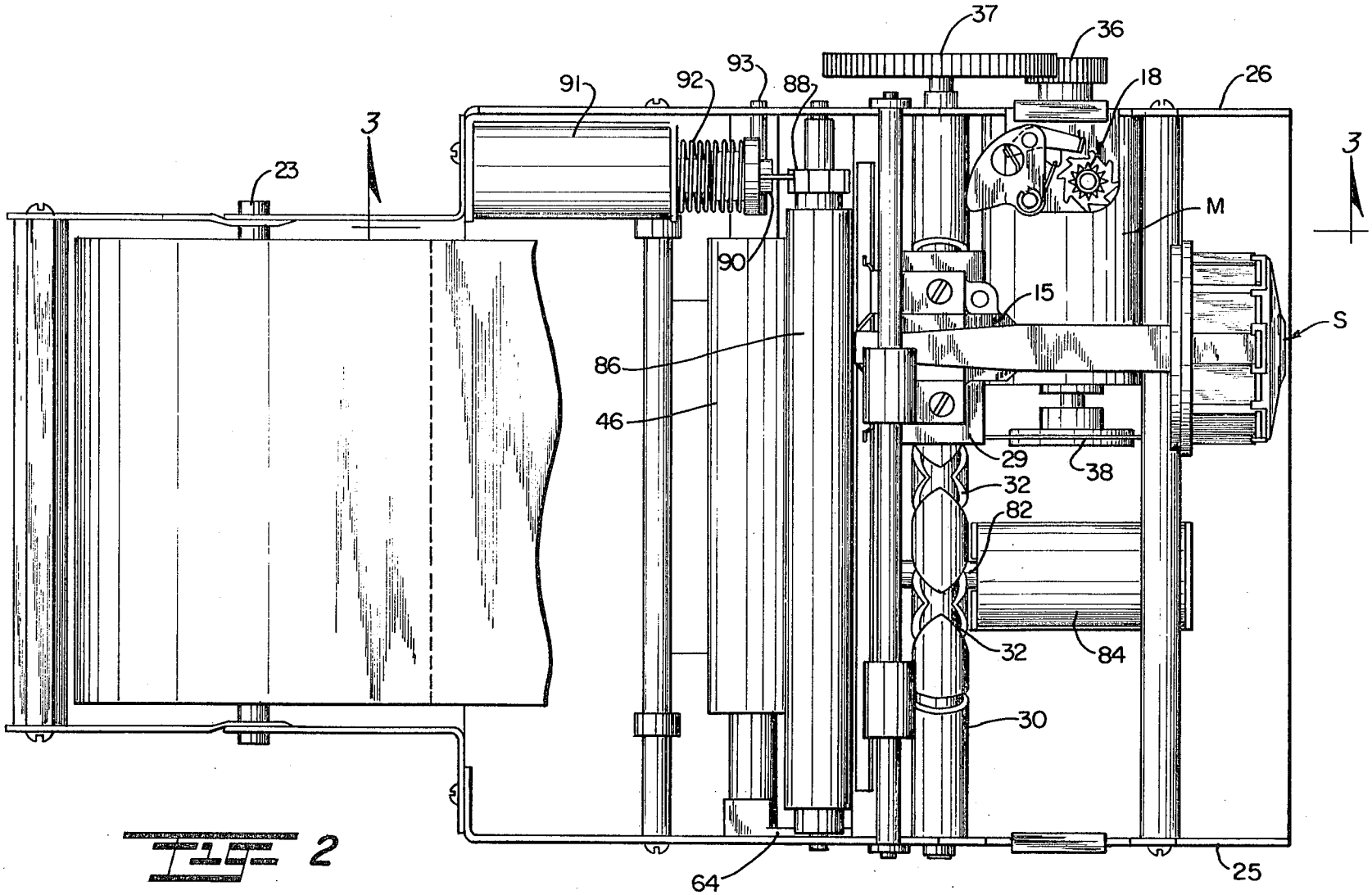
FIG. 2 is a plan view of the preferred form of the present invention.
Figure 3:
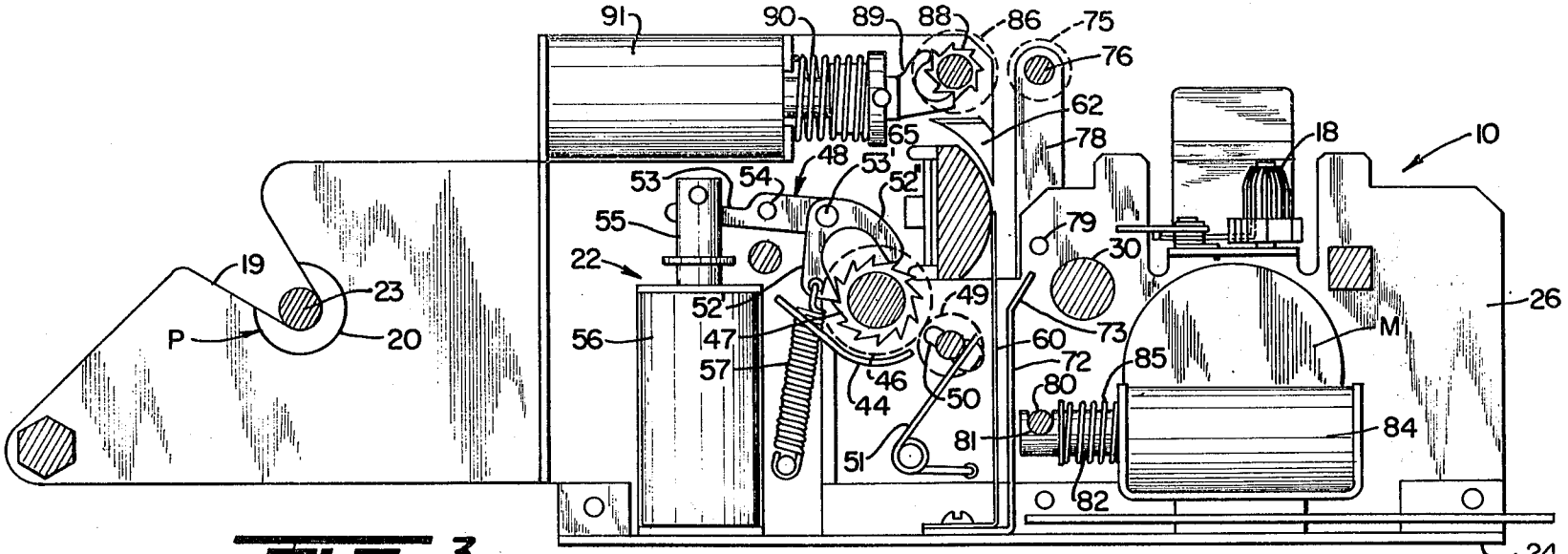
FIG. 3 is a side view, partially in section of the preferred form shown in FIG. 1.
Figure 4:
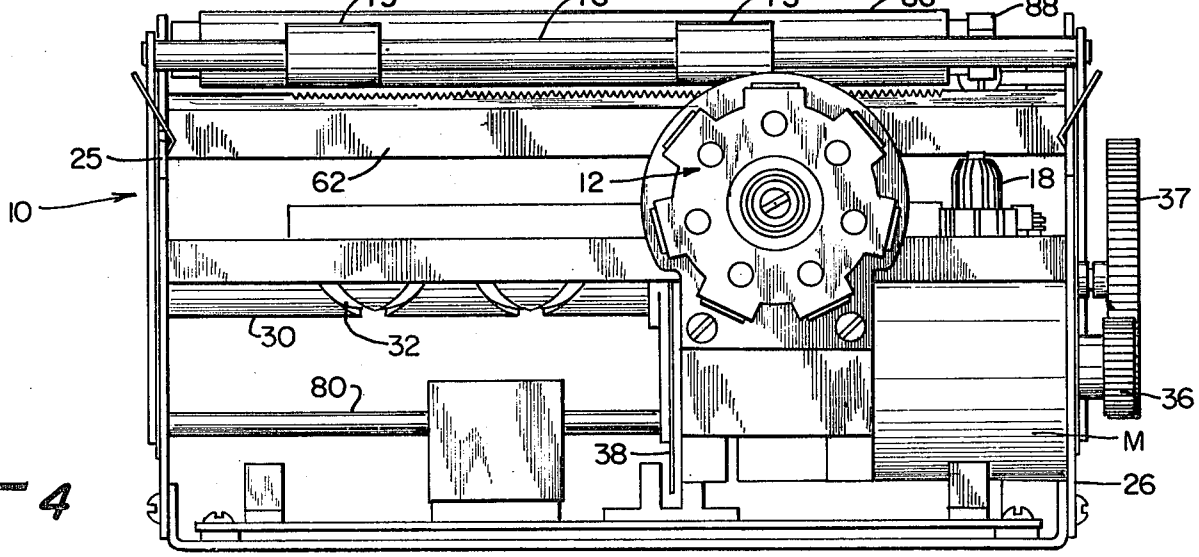
FIG. 4 is a front view of the preferred form of invention shown in FIGS. 1 and 2.

It should be noted at this juncture that the paper feed and document feed pawls operate independently of one another to index or line-feed the paper and document, respectively, under the control of their respective solenoids. Essentially, each pawl mechanism operates in the same manner to rely upon spring force to advance its associated ratchet in order to index the paper or document. In each case, when the solenoid is deenergized, the pawl is in a position such that the drive arm and detent arm bear against circumferentially spaced teeth on the ratchet so as to lock the associated roller against shifting or movement in either direction. When the solenoid is energized, it will be operative to overcome spring force to retract the pawl away from engagement with the ratchet. When this occurs, however, the limit or detent arm is removed only for a limited time interval from engagement with a ratchet tooth instantaneously before the solenoid is deenergized, at which point the return spring will cause the drive arm of the pawl to engage the next tooth in succession so as to advance the roller and index the paper one line. The limit arm will return into engagement with the next tooth in succession a limited time interval after the drive arm starts to advance the ratchet by sliding along the back surface of the preceding tooth until it becomes fully seated in the groove and abuts the next tooth so as to lock the ratchet member against continued rotation. The limit arm thus acts as a stop both to limit the length of stroke of the armature and the drive arm in that it acts in opposition to the drive arm. The mounting of the spring elements differ on the paper feed pawl and document feed pawl in that the return spring 57 is secured to the terminal end of the drive arm just rearwardly of and below the pivotal end of the pawl so as to shift the drive arm somewhat to the left in urging the arm against each tooth in succession as illustrated in FIG. 2.

In operation, the paper supply 20 is first positioned so that the paper can be threaded along the guide path between the pressure rolls 46 and 49 in front of the print bar 42 and beneath the tearoff blade 62. For this purpose, the tearoff blade 62 can be pivoted upwardly by the side arms 64 to permit the leading edge of the paper to be inserted beneath the blade and drawn rearwardly over the top of the printer. The ribbon cartridge C and print head 12 form no part of the present invention but are generally described as a setting for the construction and use of the preferred form of line feed mechanisms as described. Typically, the print head 12 is of a type capable of printing in both directions of movement across the paper and is stopped at either the left or right end of the drive cam 30. An inked ribbon R is contained in a throw-away cartridge and advanced across the print bar by the drive pawl and ratchet assembly 18 in correlation with the movement of the print head passing the righthand margin.

The line feed mechanism for the paper is controlled by the activation of the solenoid 56 in coordination with the advancement of the print head so that as the print head completes a line of print, the solenoid is energized for a brief time interval, such as, on the order of 25 ms. to release the feed pawl 48 from the ratchet. Upon deenergization the pawl is returned into engagement with the ratchet 47 to index the feed roll 46 and advance the paper roll line.

The ticket or document feed mechanism is designed to permit either single or multi-line validation independently of the paper feed. Thus, when a ticket is inserted in the slot 70, its presence is sensed by a blank which interfaces with a logic control circuit for the printer in order to correlate the operation of the document feed pawl and solenoid control 84 for the pressure feed rollers 75 and 86 in synchronization with the advancement of the print head. Thus, as described the solenoid 84 is energized to retract the lower end 80 of the bales 78 to cause the pressure roll 75 to move into engagement with the document and to press it against the feed roll 86. At the end of each line printed, the pawl control solenoid 90 is energized momentarily to release the drive pawl 89 from engagement with the ratchet 88; and upon deenergization of the solenoid 90, the pawl will be extended by the spring element 92 into engagement with the ratchet to index the ratchet and associated drive roller 86 a distance causing the document to advance upwardly one line for printing of the next line in succession. Printing on the document is done independently of the paper P, or in other words, the printing of the desired information on the document is not intended to be simultaneously printed on the paper P, although the paper may remain in position across the front of the print bar 42.

It will be evident from the foregoing that the line feed mechanism of the present invention has useful application to various types of printers other than the specific type described and shown. Thus, for instance, separate line feed mechanisms may be employed to control advancement of two different record media in side-by-side relation across the print bar in addition to independent validation or printing of information on the document inserted into the slot 70.

Although the present invention has been described with particularity relative to the foregoing detailed description of the preferred embodiment, various modifications, changes, additions and applications other than those specifically mentioned herein will be readily apparent to those having normal skill in the art without departing from the spirit and scope of this invention.

I claim:

1. In a printer having a frame upon which is mounted a pair of record media advancing rollers having external surfaces engageable with one another to form a guide path for advancement of a record medium therebetween and into position for impression of characters thereon by a print head, the improvement comprising:

incremental drive means associated with one of said record medium drive rollers including a ratchet member mounted on said one recording medium drive roller and indexing means having a pivotal feed pawl of generally U-shaped configuration, said feed pawl defining a drive arm and limit arm movable into engagement with circumferentially spaced teeth on said ratchet member, said indexing means including means normally urging said drive arm and limit arm into engagement with said ratchet member, releasing means selectively energizable to advance said drive arm and limit arm away from engagement with said ratchet member, said indexing means operative when said releasing means is de-energized to move said drive arm into engagement with one of said ratchet teeth to advance said one record medium advancing roller a limited distance prior to engagement by said limit arm with a circumferentially spaced tooth on said ratchet member to prevent further advancement of said one record medium advancing rollers.

2. In a printer according to claim 1, said drive arm having a free end shaped to conform to the configuration of the groove between each pair of adjacent teeth on said ratchet member.

3. In a printer according to claim 1, said limit arm having a free end of generally rounded configuration and adapted to be movable into sliding engagement with the back surface of a tooth on said ratchet member.

4. In a printer according to claim 1, wherein said indexing means includes a spring element engageable with said drive arm to normally urge said drive arm and limit arm into engagement with said ratchet member.

5. In a printer according to claim 1, said releasing means defined by an electromagnetic actuator having a plunger movable in response to energization of said electromagnetic actuator, said feed pawl pivotally connected to said plunger for movement away from engagement with said ratchet member when said electromagnetic actuator is energized.

6. In a printer according to claim 5, including an intermediate pivotal arm member interposed between said feed pawl and said plunger.

7. In a printer according to claim 2, said indexing means having a spring member affixed to the free end of said drive arm and operative to bias the free end of said drive arm in a direction substantially tangent to said ratchet member.

8. In a printer apparatus wherein a first line feed mechanism controls the advancement of a record medium past a stationary print bar in correlation with the lateral line printing movement of a print head, the improvement comprising:

a document feed mechanism for selectively controlling the indexing of a document superimposed on the record medium independently of said line feed mechanism past said print head, said document feed mechanism having means establishing a guide path for insertion of a document between said print bar and said print head, said last named means including document advancing rollers provided with external surfaces engageable with one another on said guide path; and incremental drive means associated with one of said document advancing rollers including a ratchet member mounted on said one roller and indexing means having a pivotal feed pawl of generally U-shaped configuration movable into engagement with circumferentially spaced teeth on said ratchet member, and feed pawl drive means selectively energizable to control movement of said feed pawl with respect to said ratchet member whereby to effect line feeding of said document along said guide path independently of line feeding of said record medium.

9. In a printer mechanism according to claim 8, including a generally wedge-shaped tearoff blade pivotally mounted for extension in closely-spaced parallel relation above said print bar to define a rearwardly directed guide path for travel of the record medium away from said print bar.

10. In a printer mechanism according to claim 9, said tearoff blade including means pivotally mounting said blade with respect to said print bar for movement between a position contiguous to said print bar and a raised upwardly inclined position away from said print bar.

11. In a printer apparatus according to claim 8 including opposite side frame members and a vertical slot in one of said side frame members defining a portion of the guide path for said document feed mechanism.

12. In a printer apparatus according to claim 11 including pivotal arm members mounted in said side frame members to support the other of said document advancing rollers in normally spaced relation to said one document advancing roller, and solenoid activated means engageable with said arm members to selectively pivot said arm members to a position causing the other of said document advancing rollers to move into engagement with said one document advancing roller.

13. In a printer apparatus according to claim 12, said one document advancing roller being spaced above said print bar on one side of said guide path and the other of said document advancing rollers being spaced above said print head on the other side of said guide path.

14. In a printer having a frame upon which is mounted a pair of record media advancing rollers having external surfaces engageable with one another to form a guide path for advancement of a first record medium therebetween and into position for impression of characters thereon by a print head, the combination therewith comprising:

a first line feed mechanism associated with one of said record medium drive rollers including a ratchet member mounted thereon and indexing means having a pivotal feed pawl provided with a drive arm and limit arm movable into engagement with circumferentially spaced teeth on said ratchet member, means normally urging said drive arm and limit arm into engagement with said teeth, releasing means selectively energizable to advance said drive arm and limit arm away from engagement with said ratchet member, said drive means operative to move said feed pawl into engagement with said ratchet member when said release means is de-energized whereby said drive arm is caused to move into engagement with one of said ratchet teeth to advance said record medium advancing roller a limited distance prior to engagement by said limit arm with a circumferentially spaced tooth on said ratchet member; and a second line feed mechanism for selectively controlling line feeding of a second record medium independently of said first line feed mechanism past said print head, said second line feed mechanism having means establishing a guide path for insertion of the second record medium between said print bar and said print head, said last named means including pressure feed rollers provided with external surfaces engageable with one another on said guide path, incremental drive means associated with one of said pressure feed rollers including a ratchet member mounted on said one roller and indexing means having a pivotal feed pawl of generally U-shaped configuration movable into engagement with circumferentially spaced teeth on said ratchet member, and feed pawl drive means selectively energizable to control movement of said feed pawl with respect to said ratchet member whereby to effect line feeding of said second record medium along said guide path independently of line feeding of said first record medium.

15. In a printer according to claim 14, each feed pawl provided with a drive arm having a free end shaped to conform to the configuration of the groove between each pair of teeth on an associated ratchet member, and a limit arm having a free end of generally rounded configuration and adapted to be movable into sliding engagement with the back surface of a tooth on an associated ratchet.

16. In a printer according to claim 15, wherein said drive means for each said pawl is defined by a spring element engageable with said drive arm and being operative to bias the free end of said drive arm in a direction substantially tangent to said ratchet member.

17. In a printer according to claim 14, said second line feed mechanism having releasing means defined by a solenoid including an armature movable in response to energization of said solenoid, said pivotal feed pawl pivotally connected to said armature for movement away from engagement with said ratchet member when said solenoid is energized.

18. In a printer according to claim 14, a generally wedge-shaped tearoff blade pivotally mounted for extension in closely-spaced parallel relation above said print bar to define a rearwardly directed guide path for travel of the first record medium away from said print bar, said tearoff blade including means pivotally mounting said blade with respect to said print bar for movement between a position contiguous to said print bar and a raised upwardly inclined position away from said print bar.

19. In a printer apparatus according to claim 18 pivotal arm members mounted in said side frame members to support the other of said pressure feed rollers in normally spaced relation to said one pressure feed roller, and solenoid activated means engageable with said arm members to selectively pivot said arm members to a position causing the other of said pressure feed rollers to engage said one pressure feed roller.

20. In a printer according to claim 19, said one pressure feed roller being spaced above said print bar on one side of said guide path and the other of said pressure feed rollers being spaced above said print head on the other side of said guide path.

* * * * *